US008011211B2

(12) United States Patent
Ahn

(10) Patent No.: US 8,011,211 B2
(45) Date of Patent: Sep. 6, 2011

(54) DRUM ASSEMBLY IN WASHING MACHINE AND METHOD FOR FABRICATING THE SAME

(75) Inventor: In Geun Ahn, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1033 days.

(21) Appl. No.: 10/969,057

(22) Filed: Oct. 21, 2004

(65) Prior Publication Data

US 2005/0229651 A1 Oct. 20, 2005

(30) Foreign Application Priority Data

Apr. 19, 2004 (KR) ..... 10-2004-0026795

(51) Int. Cl.
*D06F 37/02* (2006.01)

(52) U.S. Cl. ..... 68/142

(58) Field of Classification Search ..... 68/142
See application file for complete search history.

(56) References Cited

U.S. PATENT DOCUMENTS

| | | | | |
|---|---|---|---|---|
| 1,472,434 | A | 10/1923 | Oberg | |
| 2,173,603 | A | 9/1939 | Dodge | |
| 2,742,772 | A * | 4/1956 | Romine | 68/23.4 |
| 3,147,721 | A | 9/1964 | Holmes | |
| 3,616,662 | A * | 11/1971 | Brucken | 68/28 |
| 3,805,563 | A | 4/1974 | Wendorf | |
| 4,116,361 | A | 9/1978 | Stargell | |
| 5,746,070 | A * | 5/1998 | Bailey et al. | 68/24 |
| 5,979,195 | A | 11/1999 | Bestell et al. | |
| 6,460,382 | B1 * | 10/2002 | Kim et al. | 68/140 |
| 6,539,753 | B1 | 4/2003 | Ito et al. | |
| 2004/0103698 | A1 * | 6/2004 | Kim et al. | 68/142 |

FOREIGN PATENT DOCUMENTS

| | | | |
|---|---|---|---|
| CN | 1257559 | | 6/2000 |
| CN | 1293276 | | 5/2001 |
| DE | 2432465 | A * | 1/1976 |
| DE | 2826506 | | 1/1979 |
| GB | 471 970 | | 9/1937 |
| GB | 1 388 731 | | 3/1975 |
| GB | 1 466 105 | | 3/1977 |
| JP | 6198718 | | 7/1994 |
| JP | 07-39681 | | 2/1995 |
| JP | 10-328478 | * | 12/1998 |
| JP | 2000-254384 | | 9/2000 |
| JP | 2003-126595 | | 5/2003 |
| JP | 2004-105250 | | 4/2004 |
| KR | 10-2003-0060550 | | 7/2003 |
| KR | 10-2003-0060551 | A | 7/2003 |

* cited by examiner

*Primary Examiner* — Michael Barr
*Assistant Examiner* — Jason Riggleman
(74) *Attorney, Agent, or Firm* — McKenna Long & Aldridge LLP

(57) ABSTRACT

Drum assembly, and method for fabricating the same is disclosed, for making a capacity larger and enhancing stiffness and strength. The drum assembly includes a drum for holding laundry, a connector attached to an outside surface of a bottom of the drum, and a driving member coupled to the connector for rotating the drum, wherein the bottom includes an expansion region unoccupied by the connector, the expansion region being protruded toward an outside of the drum, to expand a capacity of the drum. The method includes a first time pressing for pressing a plate for forming a bottom of a drum, for securing a space for expanding a capacity of the drum, and a second time pressing for forming a seat for attaching a connector connecting a driving member and the drum.

18 Claims, 8 Drawing Sheets

DRUM ASSEMBLY IN WASHING MACHINE AND METHOD FOR FABRICATING THE SAME

CROSS-REFERENCE TO RELATED APPLICATIONS

This application claims the benefit of Korean Application No. P2004-26795, filed on Apr. 19, 2004, which is hereby incorporated by reference as if fully set forth herein.

BACKGROUND OF THE INVENTION

1. Field of the Invention

The present invention relates to washing machines, and more particularly, to a drum assembly having a larger capacity, and enhanced stiffness and strength, and a method for fabricating the same.

2. Discussion of the Related Art

The washing machine is an appliance for removing dirt from laundry by using action of detergent and water. In the washing machines, there are agitator type, pulsator type, and drum type. The agitator type of washing machine washes laundry by rotating a washing pole upstanding at a center of a washing tub in left/right direction. The pulsator type washing machine washes laundry by using friction between water circulation formed by rotating a disc shaped pulsator on a bottom of the washing tub in left/right direction and laundry. The drum type washing machine washes laundry by putting water, detergent, and laundry in a drum having a plurality of tumbling ribs projected from an inside surface, and rotating the drum at a low speed.

Above washing machines have a capacity fixed according to a capacity of the washing tub or the drum (hereafter will be called as a drum, collectively) which holds the laundry. Therefore, in order to make the capacity of the washing machine larger, it is required to make a diameter or a front-rear length of the drum greater, which in turn requires making a tub that encloses the drum, and a case of the washing machine larger, that increases production cost significantly.

SUMMARY OF THE INVENTION

Accordingly, the present invention is directed to a drum assembly that substantially obviates one or more problems due to limitations and disadvantages of the related art.

An object of the present invention is to provide a drum assembly which can provide a larger capacity without changing sizes of a tub and a case.

Another object of the present invention is to provide a drum assembly which has enhanced stiffness and strength for preventing deformation of the drum when a capacity of the drum becomes larger.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drum assembly in a washing machine includes a drum for holding laundry, a connector attached to an outside surface of a bottom of the drum, and a driving member coupled to the connector for rotating the drum, wherein the bottom includes an expansion region unoccupied by the connector, the expansion region being protruded toward an outside of the drum, to expand a capacity of the drum.

In another aspect of the present invention, a drum assembly in a washing machine includes a drum for holding laundry, the drum having a bottom arranged close to an inside surface of a tub which encloses the drum for maximizing a capacity, a connector attached to an outside surface of the bottom of the drum, and a driving member passed through the tub, and coupled to the connector for rotating the drum, wherein the bottom includes a region close to the tub, and a seat depressed in the region for inserting the connector therein, to prevent the connector from being brought into contact with an inside surface of the tub.

In another aspect of the present invention, a drum assembly in a washing machine includes a drum for holding laundry, a spider attached to a bottom of the drum, and a driving member coupled to the spider with a shaft for rotating the drum, wherein the bottom of the drum includes a radial shape of seat occupied by the connector, and an expansion region protruded toward an outside of the drum along an axis direction of the drum, to expand a capacity of the drum.

In another aspect of the present invention, a method for fabricating a drum in a washing machine includes a first time pressing for pressing a plate for forming a bottom of a drum, for securing a space for expanding a capacity of the drum, and a second time pressing for forming a seat for attaching a connector connecting a driving member and the drum. The method further includes forming a plurality of apertures in the region.

The step of the first time pressing includes the step of pressing a central portion of the plate to backward with reference to a circumference. The first time pressing includes forming a rim of the bottom parallel to an axis of the drum, and forming an expansion region depressed from a position before the first time pressing of the plate is done. The first time pressing further includes forming a round portion between the rim and the region. The first time pressing further includes forming at least one reinforcing rib protruded toward a direction opposite to a direction of the first time pressing from the region, for improving stiffness and strength of the bottom. The first time pressing further includes forming a stepped portion in the region concentric with the rim. The first time pressing further includes forming at least one protruded portion protruded from the stepped portion toward a radial direction of the bottom, for enhancing stiffness and strength of the bottom.

The step of the second time pressing includes the step of pressing a portion of a protruded portion by the first time pressing in a direction opposite to a protruded direction. The seat is formed in a radial shape on a backside of the bottom. The seat has a depth which becomes the deeper as it goes toward a center from a radial direction end portion the farther. The seat includes a plurality of branches spaced from one another, each formed from the center of the bottom up to the rim. The seat has a depth the same with, or greater than a thickness of the connector. The seat is positioned the same with a position of the plate before the first time pressing, or between positions of the plate before and after the first time pressing. The second time pressing further includes forming at least one reinforcing rib protruded from the region in a direction opposite to a direction of the first time pressing for improving stiffness and strength of the bottom.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
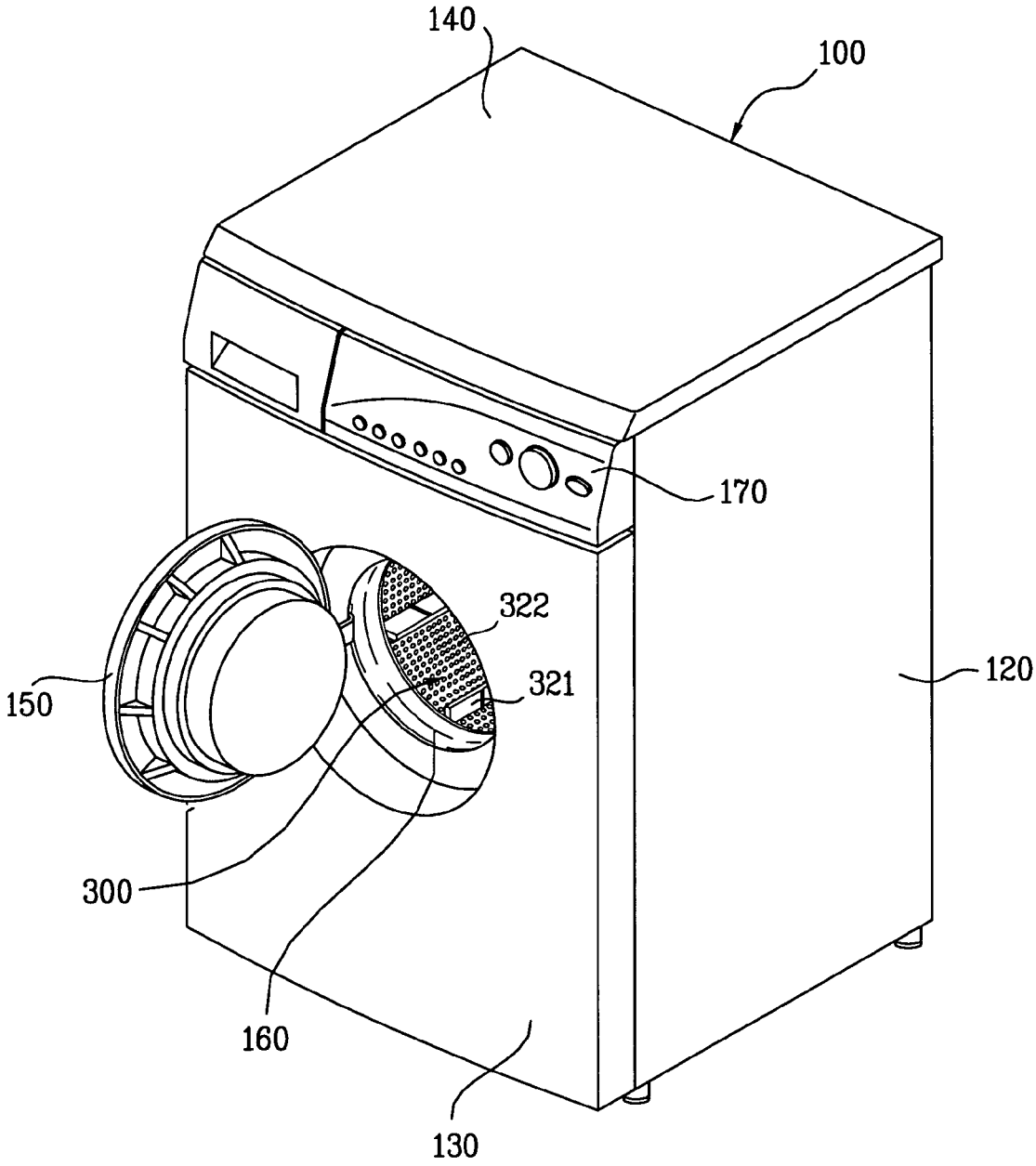
FIG. 1 illustrates a perspective view of a washing machine in accordance with a preferred embodiment of the present invention.
Figure 2:
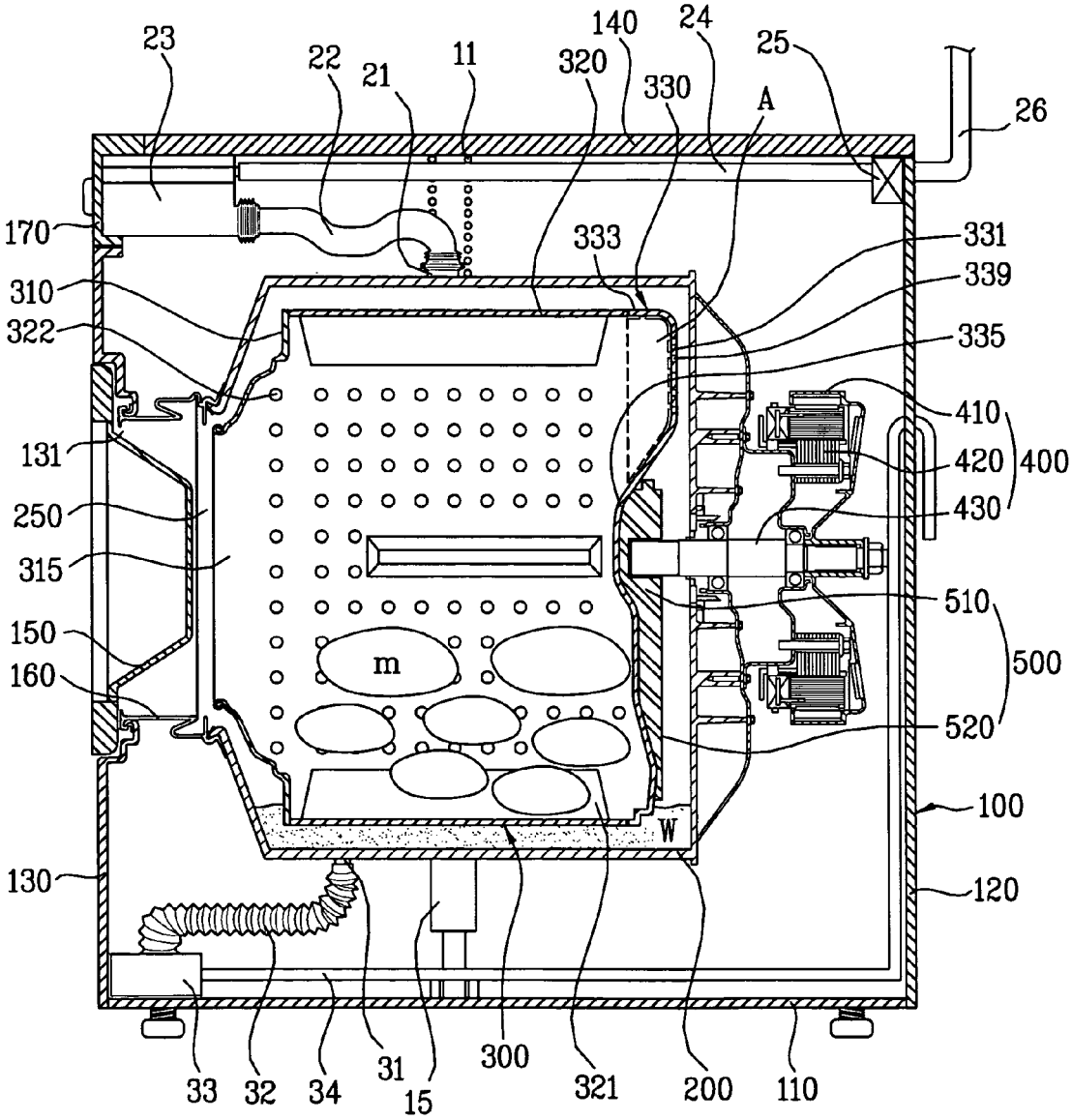
FIG. 2 illustrates a section of the washing machine in FIG. 1.
Figure 3:
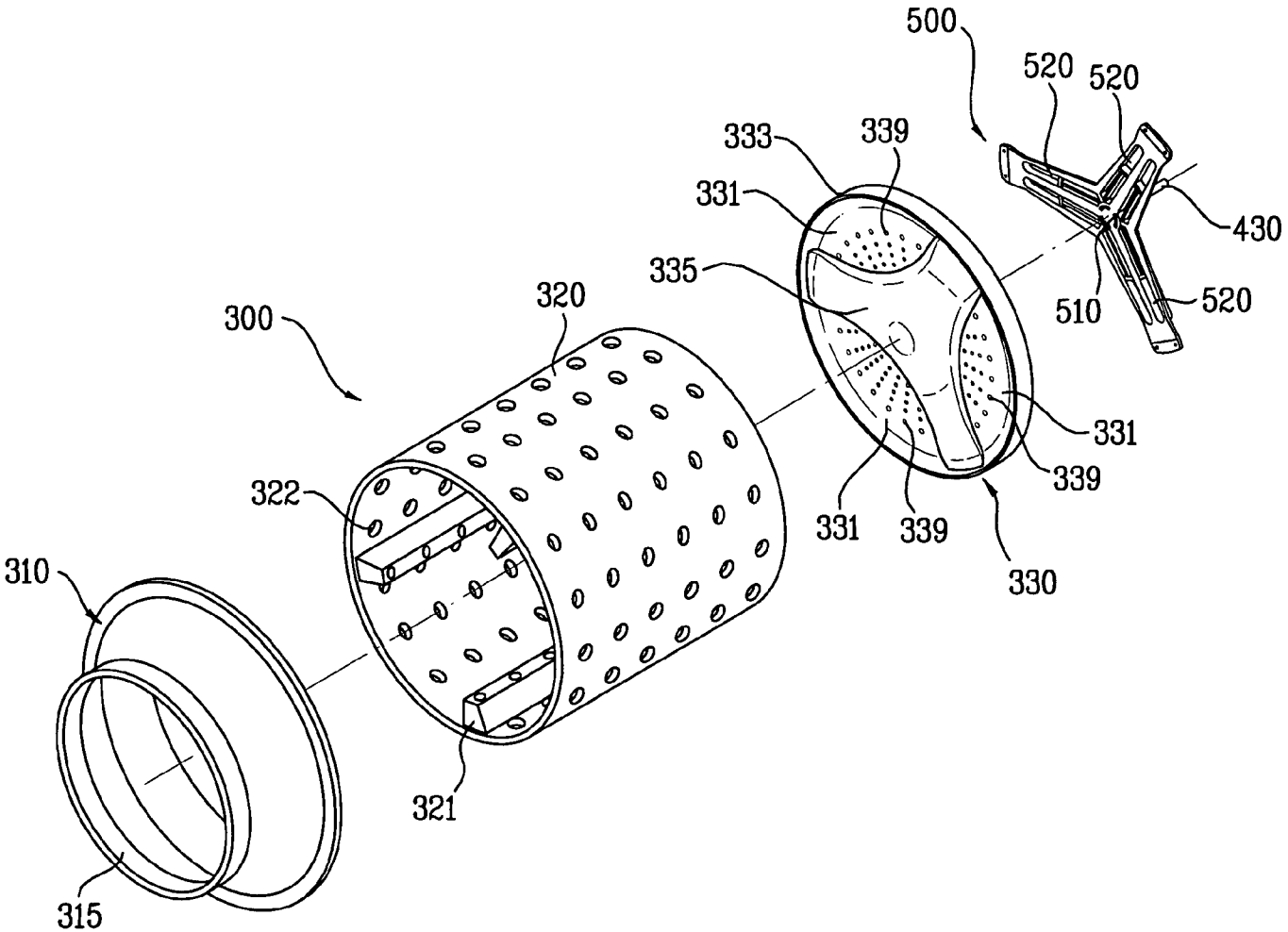
FIG. 3 illustrates a disassembled perspective view of a drum assembly of the washing machine in FIG. 1.

FIG. 1 illustrates a perspective view of a washing machine in accordance with a preferred embodiment of the present invention, FIG. 2 illustrates a section of the washing machine in FIG. 1, and FIG. 3 illustrates a disassembled perspective view of a drum assembly of the washing machine in FIG. 1.

Referring to above drawings, the washing machine includes a case 100 having a base 110, a side wall 120, a front cover 130, and a top cover 140. On the base 110, there are side walls 120 which form sides and a rear of the case 100, and in front of the side walls 120, there is a front cover 130 that forms a front of the case 100. On the side walls 120 and the front cover 130, there is a top cover 140 that forms a top of the case 100. The front cover 130 has an introduction opening 131 for putting in/taking out laundry closable with a door 150. There is a control panel 170 on the front cover 130 or the top cover 140, for operation of the washing machine.

Referring to FIG. 2, in the case 100, there is a tub 200 for holding washing water. The tub 200 is hung from the case 100 by springs 11 connected to both sides of the case 100, and elastically supported on a damper 15 connected to the base 110. Both the springs 11 and the damper 15 not only suspend the tub 200 within the case 100 elastically, but also attenuate vibration occurred during operation of the washing machine for preventing transmission of the vibration from the tub 200 to the case 100.

In general, the tub 200 is a cylinder in a horizontal position, having an opening 250 in communication with the introduction opening 131 in a front, and a closed rear. The tub 200 also has a water inlet 21 for supplying washing water to the tub 200 in one side of a top, and a drain 31 in one side of a bottom for draining the washing water. There is a gasket 160 between the opening 250 in the tub 200, and the introduction opening 131, for being brought into close contact with a rear surface of the door 150 when the door 150 is closed, to prevent the washing water from leaking. There is a water supply bellows 22 connected between the water inlet 21 and a detergent box 23, there is a water supply hose 24 connected between the detergent box 23, and a water supply valve 25, and there is a water supply pipe 26 connected between the water supply valve 25 and an external water supply source. Moreover, there is a drain bellows 32 connected between the drain 31 and a drain pump 33, and there is a drain hose 34 which is in communication with an outside of the case connected to the drain pump 33.

The drum assembly of the present invention is mounted in the tub 200. The drum assembly includes a drum 300 provided in the tub 200, a connector connected to the drum 300, and a driving member connected to the connector for rotating the drum 300. The drum assembly will be described in more detail with reference to FIGS. 2 and 3.

Referring to FIG. 2, the driving member, for an example, a motor 400, is mounted on a rear of the tub 200 for rotating the drum 300, having a rotor 410, and a stator 420. For reference, FIG. 2 illustrates an outer rotor type motor 400 having the rotor 410 arranged to surround the stator 420. Referring to FIG. 2, the hollow stator 420 is fixedly secured to the rear wall of the tub 200, and the rotor 410 surrounding the stator 420 has a driving shaft 430 connected thereto. The driving shaft 430 is passed through the stator 420 and the tub 200, and connected to a connector connected to the drum 300, such as a spider 500.

The spider 500 is attached to a bottom 330 of the drum 300, and has a center portion connected to the driving shaft 430 of the driving member. As shown in FIG. 3, the spider 500 is connected to, for an example, the driving shaft 430, and has the center portion 510 attached to a rear center of the bottom 330, and a plurality of legs 520 projected from the center portion 510 in a radial direction. The spider 500 is fixedly secured to the rear surface of the bottom 330 with fastening members, such as bolts.

The drum 300, having the connector, i.e., the spider 500 connected thereto, is a horizontal cylinder, arranged in the tub 200 coaxial therewith, and mounted rotatable about the axis. The drum 300 includes a circumferential portion and the bottom 330. The circumferential portion 320 has an inside space and opposite opened ends. One opened end of the circumferential portion 320 is arranged to face the driving member, and the bottom 330 is attached to the circumferential portion 320 to close the one opened end. The other opened end of the circumferential portion of the circumferential portion 320 is arranged to face the introduction opening 131 and the opening 250, so that the laundry is put into or taken out of the drum 300 through the other opened end. The circumferential portion 320 of the drum 300 has a plurality of apertures 322, so that the washing water held on a bottom of the tub 200 or introduced into the tub 200 through the water inlet 322 is introduced into the drum 300 through the apertures 322. Since the connector is connected to an outside surface of the bottom 330, the drum 300 is rotatable within the tub 200 by the driving member. As shown in FIGS. 2 and 3, the circumferential portion 320 has a plurality of lifters 321 projected from an inside surface for lifting and dropping the laundry and the washing water when the drum 300 rotates.

The drum 300 may be fabricated as one unit, or in a plurality pieces, and assembled for easy fabrication. FIG. 3 illustrates an example in which the drum 300 is fabricated in three pieces, i.e., the cover 310, the circumferential portion 320, and the bottom 330. The cover 310 is attached to a front of the drum 300, i.e., the other opened end of the drum 300, and has an opening 315 in communication with the introduction opening 131 and the opening 250. The opening 315 has a diameter smaller than the circumferential portion 320. The circumferential portion 320 is cylindrical, and has the bottom 330 attached to the one opened end.

The drum 300 of the present invention has a capacity larger than the related art. In order to enlarge the capacity of the drum 300, the present invention suggests, not to make the diameter or the length of the circumferential portion 320 greater, but to improve a structure of the bottom 330. The structure of the bottom 330 will be described in more detail, with reference to FIGS. 4~12.

The bottom 330 includes an expansion region 331 protruded toward an outside of the drum 300 for enlarging the capacity of the drum 300. Since the expansion region 331 is protruded toward an outside of the drum 300 along the axis of the drum 300, the capacity of the drum 300 becomes the larger as much as a capacity of the expansion region 331 protruded toward the outside of the drum 300. As shown in FIG. 2, in order to maximize the capacity of the drum 300, the expansion region 331 is protruded up to a position close to an inside surface of the tub 200, i.e., the bottom of the tub 200.

As described before, the bottom 330 of the drum 300 has the connector connected thereto, and the expansion region 331 is formed in a region of the bottom 330 which is not occupied by the connector among a whole region of the bottom 330. That is, a region excluding the seat 335 of the bottom 330 the connector is attached thereto is protruded toward the outside of the drum 300 along the axis direction of the drum 300, to form the expansion region 331. Since the seat 335 is protruded toward an inside of the drum 300 relative to the expanded region 331, the seat 335 is recessed across the expansion region 331 in an outside surface of the bottom 330. The connector is mounted to the seat 335 recessed in the outside surface of the bottom 330. Moreover, the bottom 330 has a plurality of apertures 339 provided thereto for enabling the washing water to move back and forth between the drum 300 and the tub 200, for an example, in the expansion region 331. The foregoing bottom 330 structure of the drum 300 of the present invention can be embodied in various embodiments, which will be described in more detail.

Figure 4:
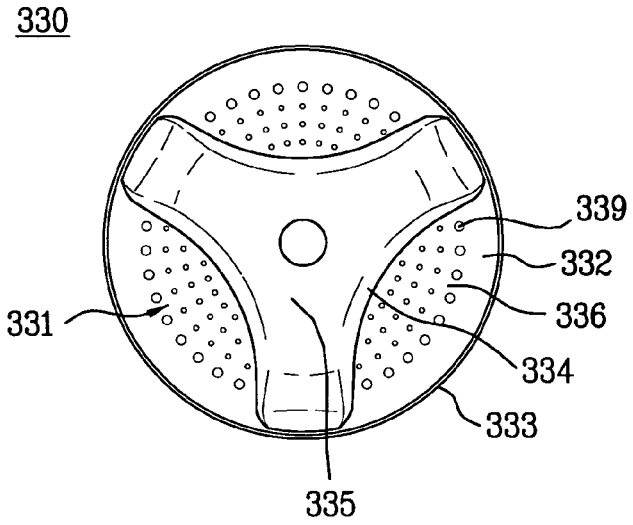
FIG. 4 illustrates a plan view of a bottom of the drum in accordance with a first preferred embodiment of the present invention.
Figure 5:
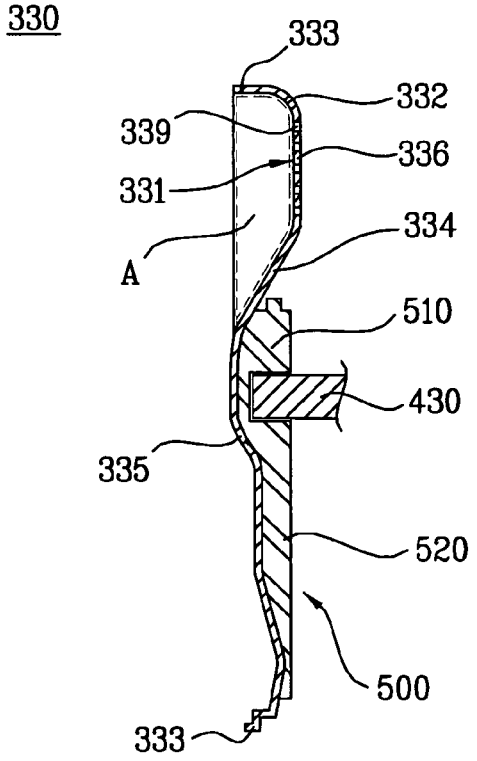
FIG. 5 illustrates a section of the bottom of the drum in FIG. 4.

FIG. 4 illustrates a plan view of a bottom of the drum in accordance with a first preferred embodiment of the present invention, and FIG. 5 illustrates a section of the bottom of the drum in FIG. 4.

Referring to FIGS. 4 and 5, the seat 335 has a shape complementary to the spider 500, for mounting the connector having three legs 520, i.e., the spider 500 thereon. That is, a center portion of the seat 335 having the center portion 510 of the spider 500 mounted thereon occupies a center portion of the bottom 330, and branches of the seat 335 having the legs 520 of the spider 500 mounted thereon are formed in a radial shape toward a rim 333 of the bottom 330 from the center portion of the seat 335. According to this, as shown in FIG. 4, the expansion region 331 of the bottom 330 is formed in regions defined by the center portion and the branches of the seat 335, and surrounded by the rim 333 of the bottom 330.

Referring to FIG. 5, the expansion region 331 adjacent to the tub 200 is protruded more than a surface of the connector, i.e., the spider 500. For this, the seat 335 has a depth deeper than the spider 500, for preventing the spider 500 from coming into contact with an inside surface of the tub 200 during rotation of the drum 300. Moreover, since the center portion 510 of the spider 500 has a thickness thicker than an end of the leg 520, the seat 335 has a depth which becomes the deeper as it goes toward the center the farther in a radial direction from an outer side.

The bottom 330 has an even thickness substantially, and the inside surface of the bottom 330 at the expansion region 331 is protruded toward the outside of the drum 300 more than the inside surface of the bottom 330 at the seat 335. Accordingly, as shown in FIG. 5, the capacity of the drum 300 becomes greater by a capacity "A" defined by the expansion region 331. The rim of the bottom 330 is parallel to the axis of the drum 300, and the seat 335 having the spider 500 mounted thereon is joined with the expansion region 331 with a slope. There is a flat portion 336 between a sloped portion 334 and the rim 333 of the bottom 330, and there is a curved segment 332 between the flat portion 336 and the rim 333 of the bottom 330. In the meantime, there are a lot of apertures 339 in the expansion region 331, and a portion that connects the expansion region 331 to the rim 333 of the bottom 330 is rounded.

Figure 6:
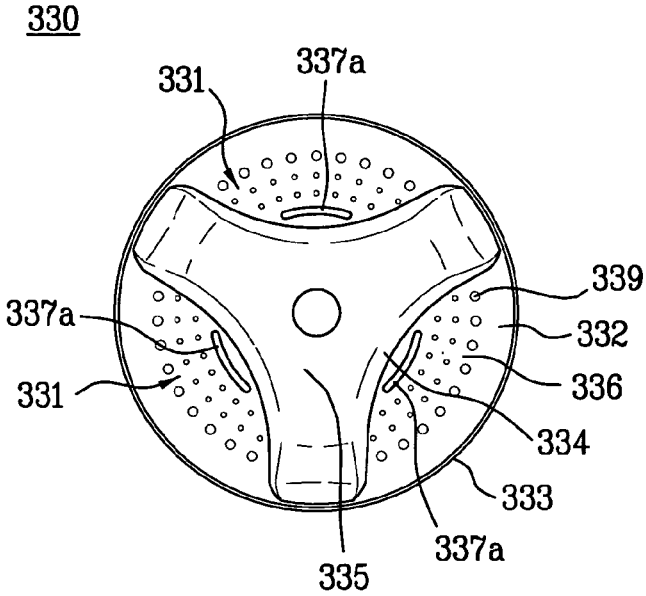
FIG. 6 illustrates a plan view of a bottom of a drum in accordance with a second preferred embodiment of the present invention.
Figure 7:
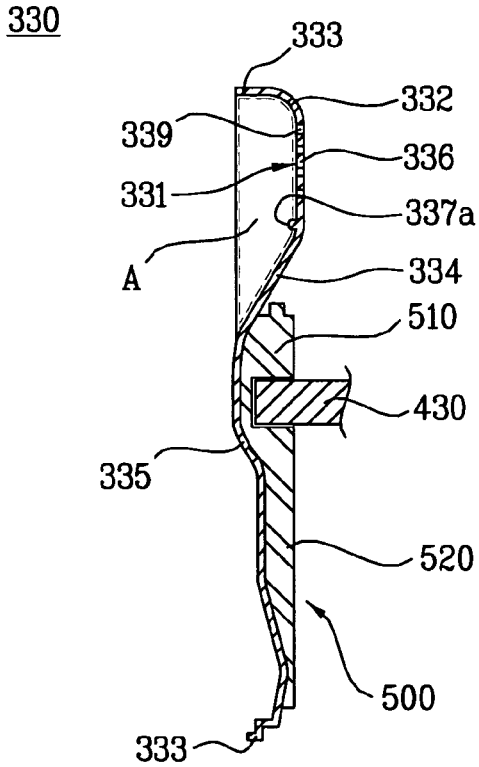
FIG. 7 illustrates a section of the bottom of the drum in FIG. 6.

FIG. 6 illustrates a plan view of a bottom of a drum in accordance with a second preferred embodiment of the present invention, and FIG. 7 illustrates a section of the bottom of the drum in FIG. 6.

Referring to FIGS. 6 and 7, it can be noted that a structure of the bottom of the drum in accordance with a second preferred embodiment of the present invention is similar to the structure of the bottom of the drum in accordance with the first preferred embodiment of the present invention, except that the bottom 330 of the second embodiment has a reinforcing rib 337*a* provided additionally for reinforcing the bottom 330, which will be described hereafter.

Referring to FIGS. 6 and 7, the expansion region 331 of the bottom 330 is provided with a reinforcing rib 337*a*, projected toward an inside of the drum from the flat portion 336 of the expansion region 331, for enhancing stiffness and strength of the bottom 330. As shown in FIGS. 6 and 7, the reinforcing rib 337*a* is provided to each of the expansion regions 331, and an arc concentric with the bottom 330 having a curvature the same with the rim 333 of the bottom 330. As shown in FIG. 7, the reinforcing rib 337*a* is formed as one unit with the bottom on the surface of the bottom 330. Of course, the reinforcing rib 337*a* may be formed by pressing the bottom 330. As described before, once the reinforcing rib 337*a* is provided to the expansion region 331, the stiffness and strength of the bottom 330 of the drum 300 is enhanced, to minimize vibration and deformation when the drum 300 is rotated.

Figure 8:
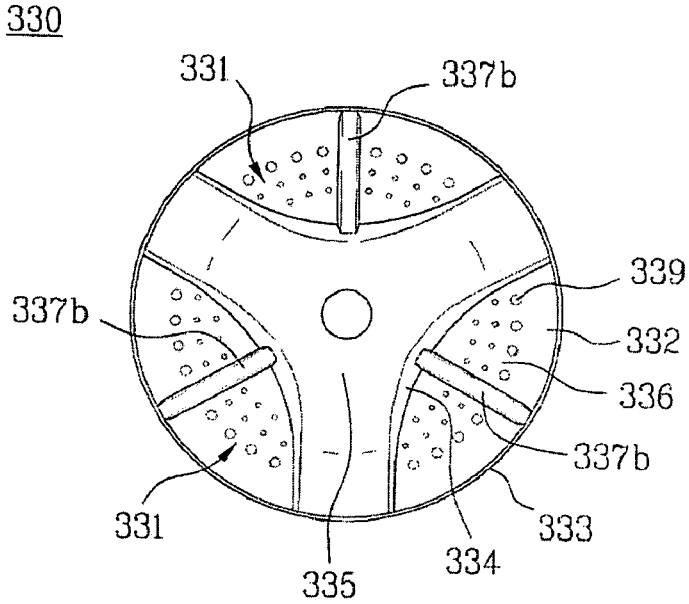
FIG. 8 illustrates a plan view of a bottom of a drum in accordance with a third preferred embodiment of the present invention.
Figure 9:
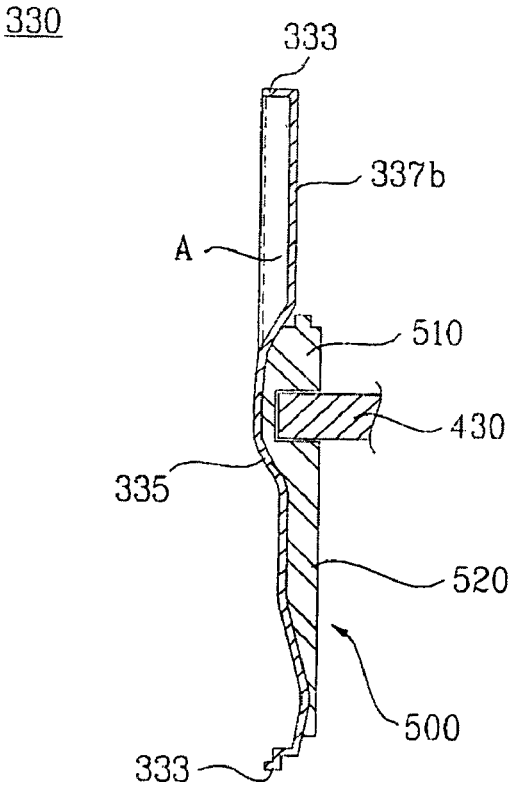
FIG. 9 illustrates a section of the bottom of the drum in FIG. 8.

FIG. 8 illustrates a plan view of a bottom of a drum in accordance with a third preferred embodiment of the present invention, and FIG. 9 illustrates a section of the bottom of the drum in FIG. 8.

Referring to FIGS. 8 and 9, the bottom of a drum in accordance with a third preferred embodiment of the present invention includes a reinforcing rib 337*b* formed on the expansion region 331 for enhancing stiffness and strength of the bottom. However, different from the second embodiment, the reinforcing rib 337*b* in the third embodiment provided to the bottom 330 is formed along a radial direction of the bottom 330. The reinforcing rib 337*b* extends from the rim 333 or the rounded portion 332 of the bottom 330 to the sloped portion 334. As shown in FIG. 9, the reinforcing rib 337*b* is formed by pressing a portion of the expansion region 331 toward an inside of the drum 300.

Figure 10:
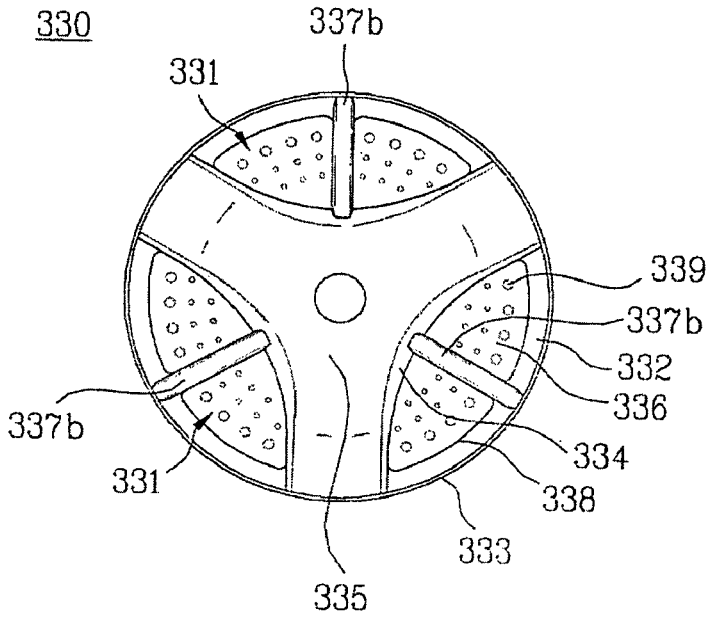
FIG. 10 illustrates a plan view of a bottom of a drum in accordance with a fourth preferred embodiment of the present invention.
Figure 11:
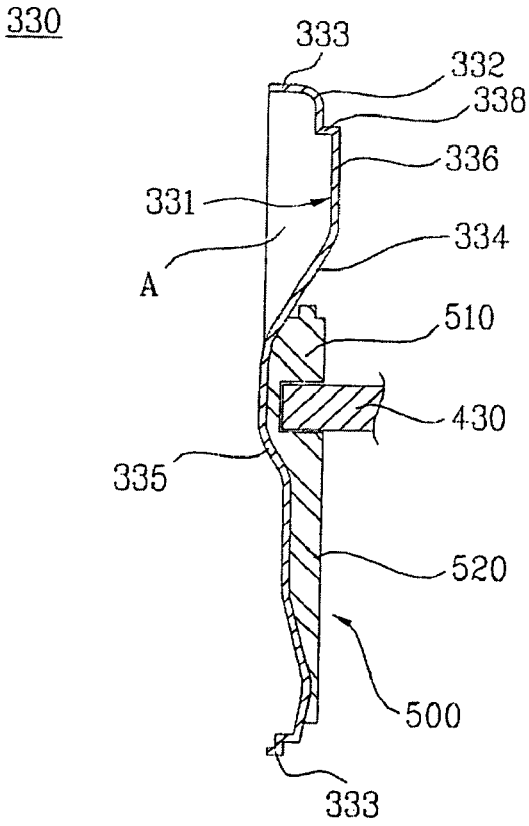
FIG. 11 illustrates a section of the bottom of the drum in FIG. 10.

FIG. 10 illustrates a plan view of a bottom of a drum in accordance with a fourth preferred embodiment of the present invention, and FIG. 11 illustrates a section of the bottom of the drum in FIG. 10.

Referring to FIGS. 10 and 11, the expansion region 331 of the bottom of the drum in accordance with a fourth preferred embodiment of the present invention is provided, not only with the reinforcing rib 337*b*, but also with a stepped portion 338. Since the reinforcing rib 337*b* has a structure the same with the third embodiment, the stepped portion 338 will be described hereafter. The stepped portion 338 is provided to the expansion region 331, for enhancing stiffness and strength of the bottom 330. As shown in FIGS. 10 and 11, the stepped portion is formed to be concentric with the rim 320 of the drum 300. In other words, a center of curvature of the stepped portion 338 is the axis of the drum 300. The stepped portion 338 is parallel to the axis of the drum 300. Of course, the structure of the stepped portion 338 is not limited to above, but may be formed sloped to the axis.

As described before, if the stepped portion 338 is provided to the bottom 330, as shown in FIG. 11, the expansion region 331 at a portion adjacent to the center of the bottom 330 with reference to the stepped portion 338 is protruded toward an outside of the drum 300 more than a portion adjacent to the rim 333 of the bottom 330. That is, the expansion region 331 includes a first portion adjacent to the rim 333 of the bottom 330 protruded from a portion having the connector attached thereto by a predetermined distance, and a second portion adjacent to the center of the bottom 330 protruded from the first portion further by a predetermined distance.

Figure 12:
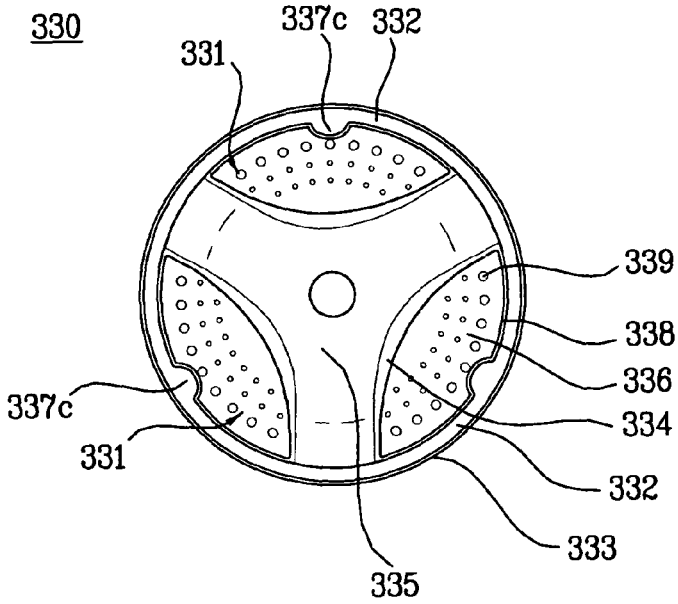
FIG. 12 illustrates a plan view of a bottom of a drum in accordance with a fifth preferred embodiment of the present invention.
Figure 13:
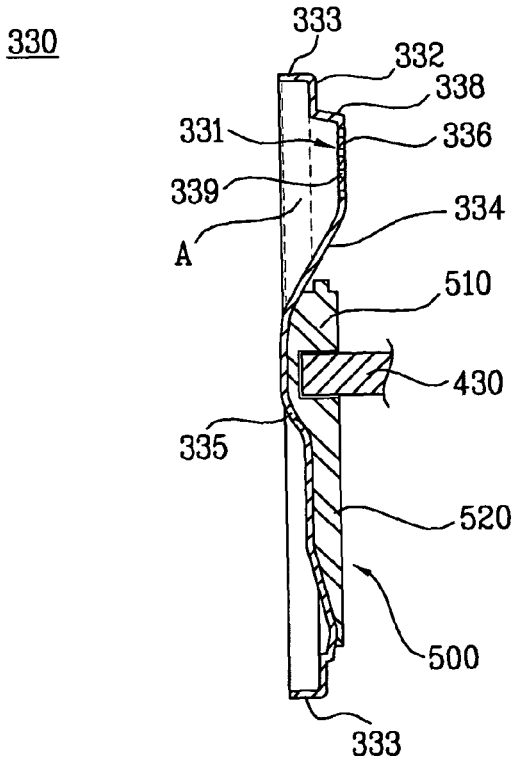
FIG. 13 illustrates a section of the bottom of the drum in FIG. 12.

FIG. 12 illustrates a plan view of a bottom of a drum in accordance with a fifth preferred embodiment of the present invention, and FIG. 13 illustrates a section of the bottom of the drum in FIG. 12.

Referring to above drawings, the expansion region 331 of the bottom of the drum in accordance with a fifth preferred embodiment of the present invention is provided with a stepped portion 338, and protruded portions 337*c*. The stepped portion has a structure similar to the fourth embodiment. However, as shown in FIG. 13, the stepped portion 338 may be sloped with reference to the axis of the drum 300. Of course, the structure of the stepped portion is not limited to this, but the stepped portion may be formed parallel to the axis. The protruded portion 337*c*, protruded from the stepped portion 338 toward a radial direction of the bottom 330, enhances stiffness and strength of the bottom 330. For an example, as shown in FIG. 12, the protruded portion 337*c* is protruded from the stepped portion 338 toward the axis of the drum 300. However, the structure of the protruded portion 337*c* is not limited to this, but the protruded portion 337*c* may be protruded in a direction opposite to above.

In the meantime, the bottom 330 of the drum 300 is pressed, which will be described in more detail. At first, a circular plate with an even thickness is provided for fabricating the bottom 330. When it is intended to provide the reinforcing rib 337*a* shown in FIGS. 6 and 7 to the bottom 330, a circular plate having the reinforcing ribs protruded from one side may be provided as the circular plate. However, if the reinforcing ribs 337*a* are formed by pressing, a circular plate having the same thickness substantially is provided for fabrication of the bottom 330.

The provided circular plate is subjected to pressing for the first time, for securing a space for expanding a capacity of the drum 300. In the first time pressing, a central portion of the plate is pressed backward with respect to the rim of the plate. In the first time pressing, the rim 333 of the bottom 330 parallel to the axis of the drum 300 is formed. Moreover, by the first time pressing, the expansion region 331 depressed backward from a position before the pressing is made is secured. Moreover, by the first time pressing, the round portion 332 between the rim 333 of the bottom 330 and the expansion region is formed. By the first time pressing, at least one of the ribs 337*a*, or 337*b* may be formed in the expansion region 331. As described before, the reinforcing ribs 337*a*, or 337*b* are arcs concentric with the bottom 330 having a curvature the same with the rim 333, or formed along a radial direction of the bottom 330. Also, in the first time pressing, the stepped portion 338 concentric with the rim 333 of the bottom 330 may be formed in the expansion region 331. Of course, in the first time pressing, the protruded portions 337*c* may be formed together with the stepped portion 338.

At least the expansion region 33.1 is secured in the first time pressing, a second time pressing is performed for forming the seat 335 for attaching the connector, i.e., the spider 500 thereto. In the second time pressing, a portion of the portion protruded in the first time pressing, i.e., the expansion region 331, is pressed in a direction opposite to a direction having the expansion region 331 protruded therein. Since a structure of the seat 335 was described in detail, repetitive description of which will be omitted. In the meantime, a position of the seat 335 formed in the second time pressing is the same with a position of the plate before the plate is pressed for the first time, or between a position of the plate before the first time pressing and a position of the plate after the first time pressing, i.e., the expansion region 331. In the meantime, it was described that the reinforcing ribs 337*a*, or 337*b* and the protruded portions 337*c* can be formed in the first time pressing. However, the reinforcing ribs 337*a*, or 337*b* and the protruded portions 337*c* can also be formed, not in the first time pressing, but in the second time pressing.

In the meantime, if it is intended to form the apertures 339 in the bottom 330, the apertures 339 may be formed any time before the first time pressing, the second time pressing, or after the second time pressing. Or, the apertures 339 may be formed at the time of first or second time pressing.

The operation of the washing machine having the drum assembly of the present invention applied thereto will be described. Upon opening the door 150 in FIG. 1, introducing laundry 'm' into the drum 300, and putting the washing machine into operation, washing water is supplied to the drum 300 and the tub 200. In this instance, since the drum 300 has a capacity larger by the capacity "A" of the expansion region 331 of the bottom 330, more laundry can be introduced into the drum 300. Upon finishing supply of the washing water, the driving member connected to the connector rotates the drum 300. As the drum 300 rotates, the laundry and the washing water in the drum 300 are lifted and dropped by the lifters 321. The laundry is washed by friction and impact occurred at this time, and chemical action of the detergent. Upon completion of the washing, dirty washing water is drained from the drum 300 and the tub 200 to an outside of the washing machine through the drain hose 34. Upon completion of the draining, water is supplied to the drum 300 and the tub 200, and the drum 300 is rotated to rinse the laundry. After rinsing the laundry for a preset time period, dirty water is drained to the outside of the washing machine, and above step is repeated, to rinse the laundry several times. After finishing the rinsing, the drum 300 is spun, to extract water from the laundry by centrifugal force. Upon finishing the spinning, the user can open the door 150, and take out the laundry from the drum 300. In the meantime, if the washing machine has a drying function provided thereto, the laundry may be dried completely after the spinning by supplying hot air to the drum 300, while rotating the drum 300.

As described before, to the drum assembly of the present invention, the expansion region is provided to the bottom of the drum. Therefore, the capacity of the drum becomes larger by the capacity of the expansion region. According to this, the capacity of the washing machine can be made larger without changing diameters, or lengths of the drum and the tub, to permit production of a washing machine having a larger capacity without an increase of production cost. The provision of the reinforcing ribs, the stepped portion, and the protruded portions to the bottom of the drum of the present invention improve stiffness and strength of the drum even if capacity of the drum becomes larger, thereby minimizing vibration and deformation of the drum during operation of the washing machine.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A drum assembly in a washing machine comprising:

a drum rotatable around an axis of rotation for holding laundry, the drum having a front wall with an opening therein for inserting and removing laundry, and a rear wall extending away from the front wall along the axis of rotation;

a spider attached to an outside surface of the rear wall, the spider having a front surface adjacent to the outside surface of the rear wall and a rear surface extending away from the front surface along the axis of rotation; and a driving member coupled to the spider for rotating the drum, wherein the rear wall includes an expansion region unoccupied by the spider, the expansion region being protruded parallel to the axis of rotation away from the front wall, wherein at least a portion of the expansion region extends past all surfaces of the spider.

2. The drum assembly as claimed in claim 1, wherein the drum includes;

a circumferential portion having an inside space, and opened opposite ends, and a bottom attached to one of the opened opposite ends of the circumferential portion.

3. The drum assembly as claimed in claim 2, wherein the drum further includes a cover having an opening with a diameter smaller than a diameter of the circumferential portion, and attached to the other one of the opened opposite ends of the circumferential portion.

4. The drum assembly as claimed in claim 1, wherein the driving member includes;

a rotor coupled to the spider with the shaft, and a stator arranged inside of the rotor such that the shaft passes therethrough.

5. The drum assembly as claimed in claim 1, wherein the rear wall includes a plurality of apertures for enabling passage of washing water.

6. The drum assembly as claimed in claim 5, wherein the apertures are provided to the expansion region.

7. The drum assembly as claimed in claim 1, wherein a rim is connected to the expansion region, and a connection portion between the rim and the expansion region is curved.

8. The drum assembly as claimed in claim 1, wherein the rear wall includes a portion having the spider attached thereto connected to the expansion region with a slope.

9. The drum assembly as claimed in claim 1, wherein the rear wall further includes:

a curved segment connecting the rim and the expansion region of the rear wall, and a sloped portion connecting a portion having the spider attached thereto and the expansion region, and a flat portion between the curved segment and the sloped portion.

10. The drum assembly as claimed in claim 1, wherein the rear wall further includes at least one reinforcing rib protruded toward an inside of the drum from the expansion region, for enhancing stiffness and strength of the rear wall.

11. The drum assembly as claimed in claim 10, wherein the reinforcing rib includes an arc shape concentric with the bottom, and having a curvature the same with the rim of the bottom.

12. The drum assembly as claimed in claim 10, wherein the reinforcing rib is formed along a radial direction of the rear wall.

13. The drum assembly as claimed in claim 10, wherein the reinforcing rib is integral to and protrudes from a portion of the expansion region toward an inside of the drum.

14. The drum assembly as claimed in claim 1, wherein the rear wall includes at least one stepped portion provided to the expansion region for enhancing stiffness and strength of the rear wall.

15. The drum assembly as claimed in claim 14, wherein the stepped portion is coaxial with the circumferential portion of the drum.

16. The drum assembly as claimed in claim 14, wherein the bottom further includes at least one protruded portion protruded from the stepped portion toward a radial direction of the bottom, for enhancing stiffness and strength of the bottom.

17. The drum assembly as claimed in claim 14, wherein the stepped portion is parallel to the axis of rotation of the drum.

18. The drum assembly as claimed in claim 14, wherein the stepped portion is sloped with respect to an axis of the drum.

* * * * *